US012252302B1

(12) United States Patent
Xu

(10) Patent No.: US 12,252,302 B1
(45) Date of Patent: Mar. 18, 2025

(54) CLOTH BAG FRAME FOR FOLDING TO SQUEEZING OUT BAR BENDS

(71) Applicant: Xianqin Xu, Zhejiang (CN)

(72) Inventor: Xianqin Xu, Zhejiang (CN)

( * ) Notice: Subject to any disclaimer, the term of this patent is extended or adjusted under 35 U.S.C. 154(b) by 0 days.

(21) Appl. No.: 18/922,382

(22) Filed: Oct. 21, 2024

(30) Foreign Application Priority Data

Aug. 29, 2024 (CN) ..... 202422124426.X

(51) Int. Cl.
*B65D 33/02* (2006.01)
*B65D 30/00* (2006.01)

(52) U.S. Cl.
CPC ..... *B65D 33/02* (2013.01); *B65D 29/00* (2013.01)

(58) Field of Classification Search
CPC ..... B65D 33/02; B65D 29/00; A45C 7/0077
USPC ..... 383/34; 220/9.2, 9.3; 190/107
See application file for complete search history.

(56) References Cited

U.S. PATENT DOCUMENTS 1,624,212 A * 4/1927 Butcher ..... B65D 37/00 220/9.3
3,233,644 A * 2/1966 Bono ..... B62B 5/0006 220/655
5,927,856 A * 7/1999 Hung ..... A45C 3/00 150/120
11,510,465 B2 11/2022 Tang
2008/0283525 A1* 11/2008 Heider ..... B65D 90/205 220/9.2
2009/0261094 A1* 10/2009 Krotts ..... D06F 95/004 220/9.2

* cited by examiner

*Primary Examiner* — Jes F Pascua
(74) *Attorney, Agent, or Firm* — Ricky Lam

(57) ABSTRACT

The present utility model pertains to the field of folding, and particularly relates to a cloth bag frame for folding to squeeze out bar bends, comprising a cloth cover, borders, a first connecting member, a connecting plate, and a cover plate. Two foldable borders are mounted on the cloth cover. The first connecting member is mounted on the right side of a left border. The connecting plate is sleeved on the first connecting member. The connecting plate and the first connecting member are in movable connection through a circular hole at a bottom portion. The cover plate for isolation from the outside world is mounted on the borders. As the present utility model additionally has the borders, the first connecting member, the connecting plate, and the cover plate, it can be folded when not in use, so that the occupied space is greatly reduced. Whether it is stored or transported, the limited space can be used more effectively. The special connection design on the left border makes it more flexible to assemble and disassemble the frame, and can better adapt to cloth covers in different sizes and shapes. The foldable design makes it more convenient and faster to unfold and fold the frame during use, thereby improving the work efficiency.

5 Claims, 8 Drawing Sheets

CLOTH BAG FRAME FOR FOLDING TO SQUEEZING OUT BAR BENDS

CLAIMS OF PRIORITY

This patent application claims priority from:

(1) CN utility model patent application number is 202422124426.X with a filing date of Aug. 29, 2024 and DAS code of F732.

TECHNICAL FIELD

The present utility model pertains to the field of folding, and particularly relates to a cloth bag frame for folding to squeeze out bar bends.

BACKGROUND

At present, in the fast-paced and highly developed fields of modern packaging and logistics, as global trade keeps expanding and people put more importance on the logistics efficiency and cost control, the demand for a cloth bag frame that is foldable and easy to store and transport has had an increasingly significant and ever-growing trend.

However, since they cannot be folded, traditional cloth bag frames will occupy a lot of storage space when not in use, which increases the storage cost and management difficulty, especially for enterprises with limited storage space. The characteristic that they cannot be folded brings about a relatively large volume in the process of transportation, which increases the difficulty and cost of transportation. During use, since they cannot be folded, the operation is relatively cumbersome, to the disadvantage of fast assembly and disassembly.

As such, given the large space occupation, high transportation cost, and the use inconvenience of the above traditional cloth bag frames, it is necessary to design a cloth bag frame for folding to squeeze out bar bends. By additionally having the borders, the first connecting member, the connecting plate, and the cover plate, it can be folded when not in use, so that the occupied space is greatly reduced. Whether it is stored or transported, the limited space can be used more effectively. The special connection design on the left border makes it more flexible to assemble and disassemble the frame, and can better adapt to cloth covers in different sizes and shapes. The foldable design makes it more convenient and faster to unfold and fold the frame during use, thereby improving the work efficiency.

SUMMARY

To solve the problems of large space occupation, high transportation cost, and use inconvenience existing in the above traditional cloth bag frames, the technical solution of the present utility model is as follows: a cloth bag frame for folding to squeeze out bar bends, comprising a cloth cover, borders, a first connecting member, a connecting plate, and a cover plate, wherein two foldable borders are mounted on the cloth cover, the first connecting member is mounted on the right side of a left border, the connecting plate is sleeved on the first connecting member, the connecting plate and the first connecting member are in movable connection through a circular hole at a bottom portion, and the cover plate for isolation from the outside world is mounted on the borders.

Preferably, by additionally having the borders, the first connecting member, the connecting plate, and the cover plate, it can be folded when not in use, so that the occupied space is greatly reduced; whether it is stored or transported, the limited space can be used more effectively; the special connection design on the left border makes it more flexible to assemble and disassemble the frame, and can better adapt to cloth covers in different sizes and shapes; the foldable design makes it more convenient and faster to unfold and fold the frame during use, thereby improving the work efficiency.

As a preferred option, handles are arranged at upper ends on both sides of the cloth cover; T-shaped plastic strips are fixedly mounted on the upper ends on left and right sides of the cloth cover; T-shaped plastic strips are in snap-fit connection with bottom portions of the borders; the cloth cover is made of a soft material; the handles are designed so that an operator can grab and lift the cloth bag frame more easily, especially when it is filled with articles; unlike a hard material, the soft material of the cloth cover will not cause discomfort when it is in contact with the operator; when the frame is folded, the soft cloth cover is deformed more easily along with the folding, and will not pose an obstruction to the folding process; the T-shaped plastic strips make the connecting structure more stable.

As a preference, a second connecting member is mounted on the left side of a right border; a connecting plate is sleeved on the second connecting member; the connecting plate and the second connecting member are in movable connection through a circular hole at a bottom portion, so that the right border can be folded flexibly, which greatly ameliorates the defect that the traditional frames cannot be folded, thereby significantly reducing the occupied space when the frame lies idle, and facilitating storage and transportation; the manner of the movable connection makes the process of assembling and disassembling the frame faster, easier, and more convenient; the reasonable design of the connecting member and the connecting plate can enhance the strength of the connection between the right border and the main body of the frame, thereby improving the structural stability of the entire frame.

As a preferred option, through holes are opened on surfaces of the first connecting member, the second connecting member, and the connecting plate; a roller runs through the first connecting member, the second connecting member, and the connecting plate; the existence of the roller greatly reduces the friction between the connecting members, smoothens the process of folding and unfolding the borders, and renders the operation easier, faster, and more convenient; the run-through connection of the roller can provide a firmer manner of connection, to ensure that it is not easy to loosen or separate the connecting members when they are subjected to an external force, thereby enhancing the structural stability of the entire frame.

As a preferred option, a groove is opened on the surface of the cover plate; a pull ring is mounted at an front end on an upper surface of the cover plate; a touch fastener is mounted at a rear end on the upper surface of the cover plate; the groove can increase the friction on the surface of the cover plate, so as to prevent articles placed on the cover plate from slipping off, and facilitate opening; when the cover plate is closed, the touch fastener at the rear end can tightly fit the cover plate to the frame and prevent opening the cover plate accidentally.

As a preference, one hole is opened on each corner at a bottom portion of the cloth cover; a cloth bag sleeve is mounted in the hole; opening the hole on each corner and mounting the cloth bag sleeve therein flexibly change the spatial layout inside the cloth cover, and improve the space utilization rate.

As a preferred option, a thick rod is mounted inside the cloth bag sleeve; a thin rod is mounted inside the thick rod; a circular hole is opened at a top portion of the thick rod and runs therethrough; a circular hole is opened at a bottom portion of the thin rod and runs therethrough; the circular hole at the bottom portion of the thin rod matches with the circular hole at the top portion of the thick rod, so that the thin rod can move up and down inside the thick rod, thereby realizing the height adjustment of the whole supporting structure and avoiding structural damage or failure; the adjustable supporting structure can better adapt to the shape and distribution of articles inside the cloth cover and provide more uniform and more effective support.

The beneficial effects of the present utility model are as follows:

1. by additionally having the borders, the first connecting member, the connecting plate, and the cover plate, it can be folded when not in use, so that the occupied space is greatly reduced; whether it is stored or transported, the limited space can be used more effectively; the special connection design on the left border makes it more flexible to assemble and disassemble the frame, and can better adapt to cloth covers in different sizes and shapes; the foldable design makes it more convenient and faster to unfold and fold the frame during use, thereby improving the work efficiency;
2. the existence of the roller greatly reduces the friction between the connecting members, smoothens the process of folding and unfolding the borders, and renders the operation easier, faster, and more convenient; the run-through connection of the roller can provide a firmer manner of connection, to ensure that it is not easy to loosen or separate the connecting members when they are subjected to an external force, thereby enhancing the structural stability of the entire frame;
3. the circular hole at the bottom portion of the thin rod matches with the circular hole at the top portion of the thick rod, so that the thin rod can move up and down inside the thick rod, thereby realizing the height adjustment of the whole supporting structure and avoiding structural damage or failure; the adjustable supporting structure can better adapt to the shape and distribution of articles inside the cloth cover and provide more uniform and more effective support.

DESCRIPTION OF REFERENCE SIGNS IN THE DRAWINGS

1. cloth cover; 2. border; 3. first connecting member; 4. connecting plate; 5. cover plate; 6. handle; 7. second connecting member; 8. roller; 9. touch fastener; 10. pull ring; 11. cloth bag sleeve; 12. thick rod; 13. circular hole; 14. thin rod; 15. T-slot plastic strip.

DESCRIPTION OF EMBODIMENTS

The present utility model is further described below in combination with the drawings and embodiments.

Figure 1:
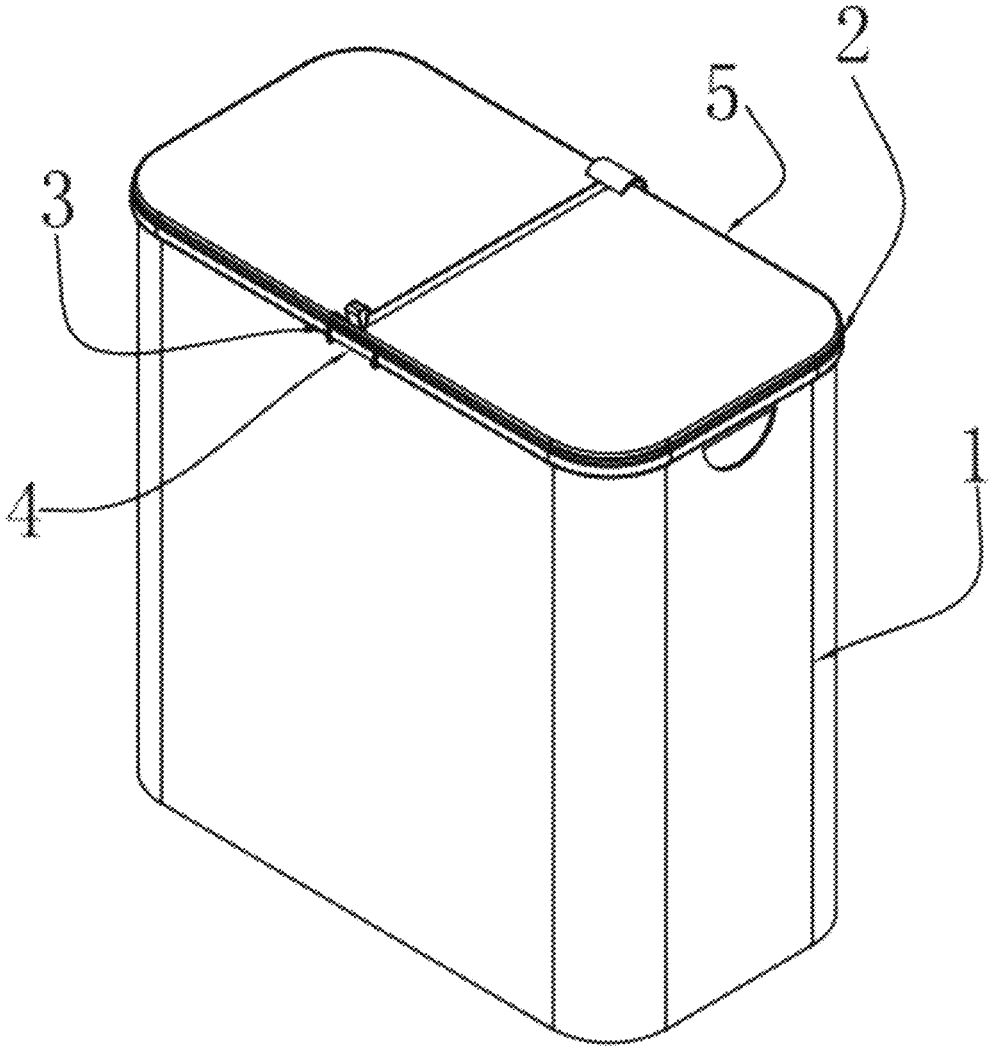
FIG. 1 is a first three-dimensional structure diagram of a cloth bag frame for folding to squeeze out bar bends in the present utility model.
Figure 2:
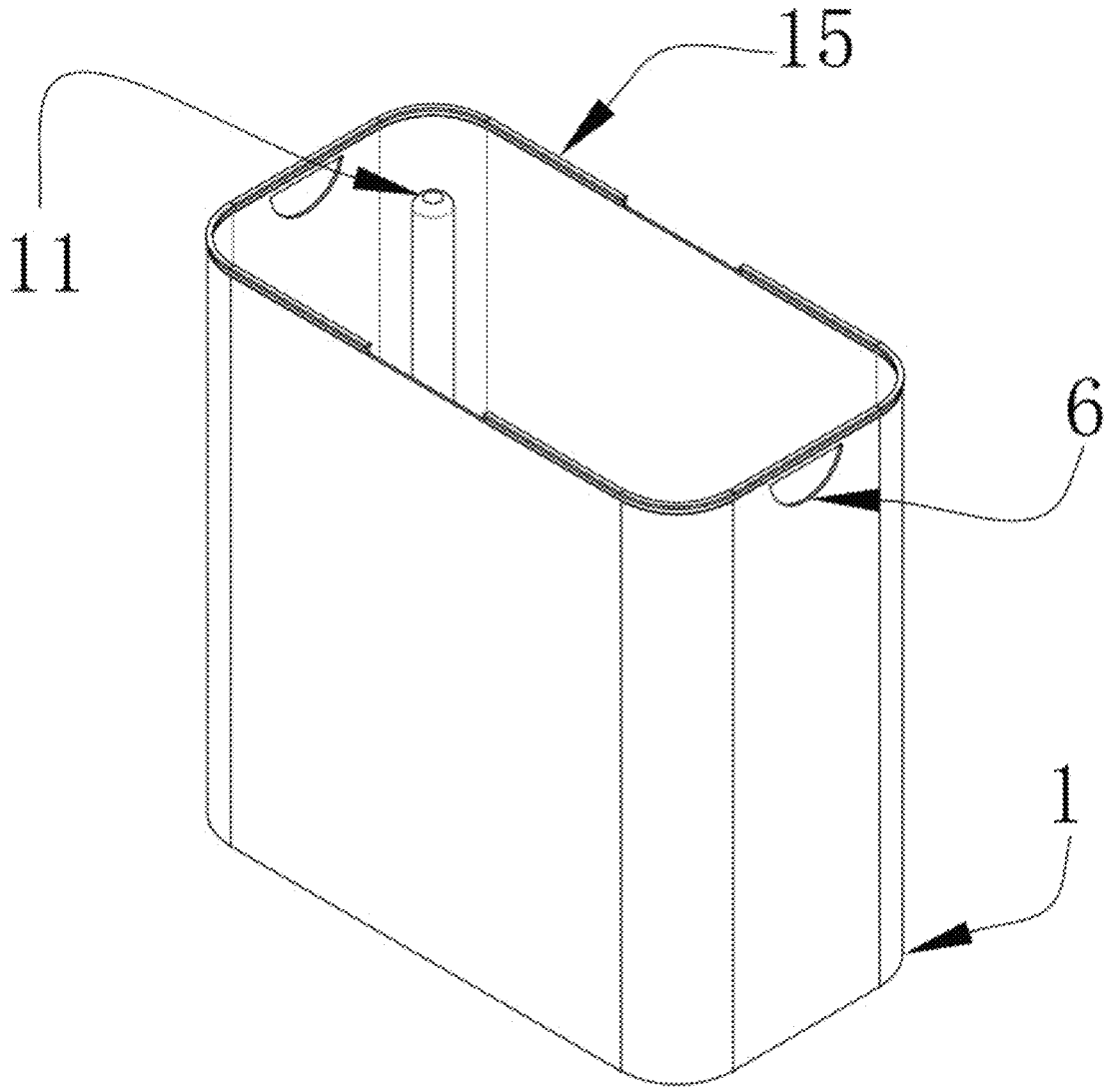
FIG. 2 is a three-dimensional structure diagram of a cloth cover of a cloth bag frame for folding to squeeze out bar bends in the present utility model.
Figure 8:
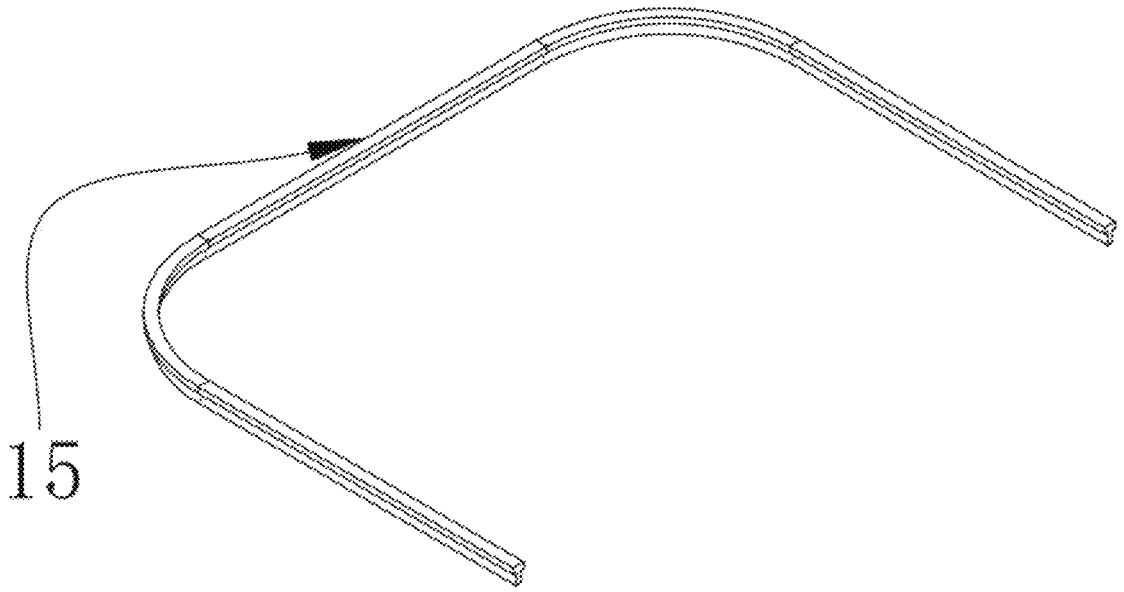
FIG. 8 is an independent enlarged three-dimensional structure diagram of a T-slot plastic strip of a cloth bag frame for folding to squeeze out bar bends in the present utility model.

Referring to FIG. 1, FIG. 2 and FIG. 8, the present utility model provides an embodiment: a cloth bag frame for folding to squeeze out bar bends, comprising a cloth cover 1, borders 2, a first connecting member 3, a connecting plate 4, and a cover plate 5; two foldable borders 2 are mounted on the cloth cover 1, the first connecting member 3 is mounted on the right side of a left border 2, the connecting plate 4 is sleeved on the first connecting member 3, the connecting plate 4 and the first connecting member 3 are in movable connection through a circular hole 13 at a bottom portion, and the cover plate 5 for isolation from the outside world is mounted on the borders 2; by additionally having the borders 2, the first connecting member 3, the connecting plate 4, and the cover plate 5, it can be folded when not in use, so that the occupied space is greatly reduced; whether it is stored or transported, the limited space can be used more effectively; the special connection design on the left border 2 makes it more flexible to assemble and disassemble the frame, and can better adapt to cloth covers 1 in different sizes and shapes; the foldable design makes it more convenient and faster to unfold and fold the frame during use, thereby improving the work efficiency; handles 6 are arranged at upper ends on both sides of the cloth cover 1; T-shaped plastic strips 15 are fixedly mounted at the upper ends on left and right sides of the cloth cover 1; T-shaped plastic strips 15 are in snap-fit connection with bottom portions of the borders; the cloth cover 1 is made of a soft material; the handles 6 are designed so that an operator can grab and lift the cloth bag frame 2 more easily, especially when it is filled with articles; unlike a hard material, the soft material of the cloth cover 1 will not cause discomfort when it is in contact with the operator; when the frame 2 is folded, the soft cloth cover 1 is deformed more easily along with the folding, and will not pose an obstruction to the folding process; the T-shaped plastic strips 15 make the connection structure more stable.

Figure 3:
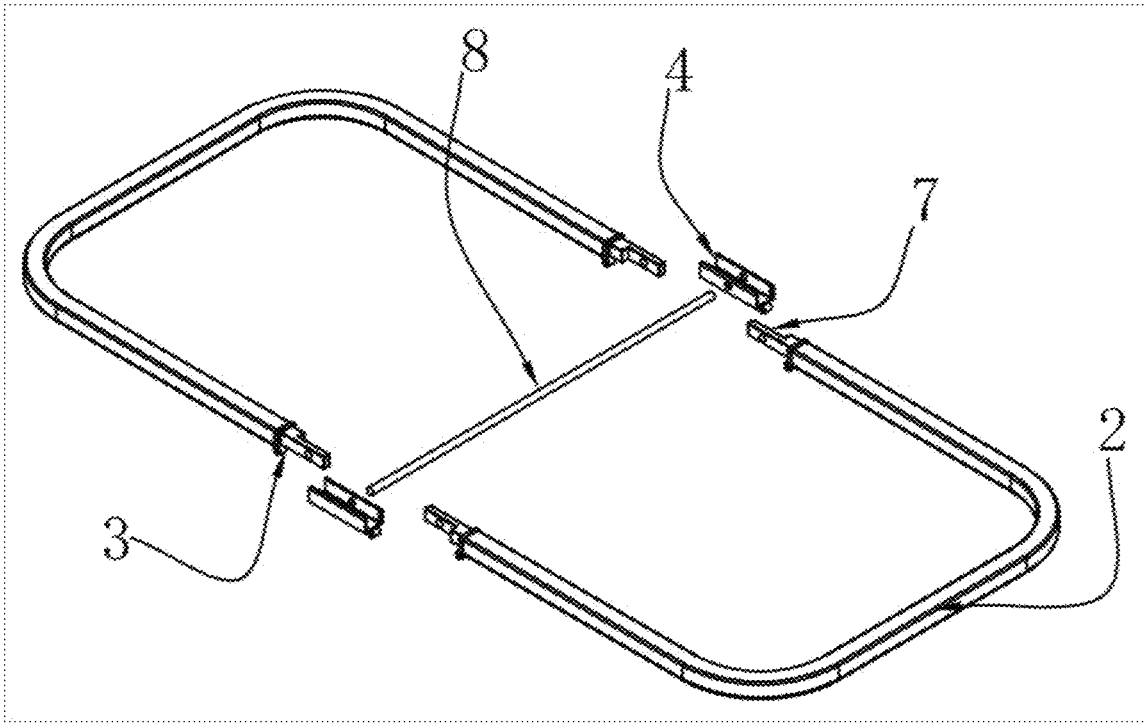
FIG. 3 is a three-dimensional structure diagram of folded borders of a cloth bag frame for folding to squeeze out bar bends in the present utility model.
Figure 4:
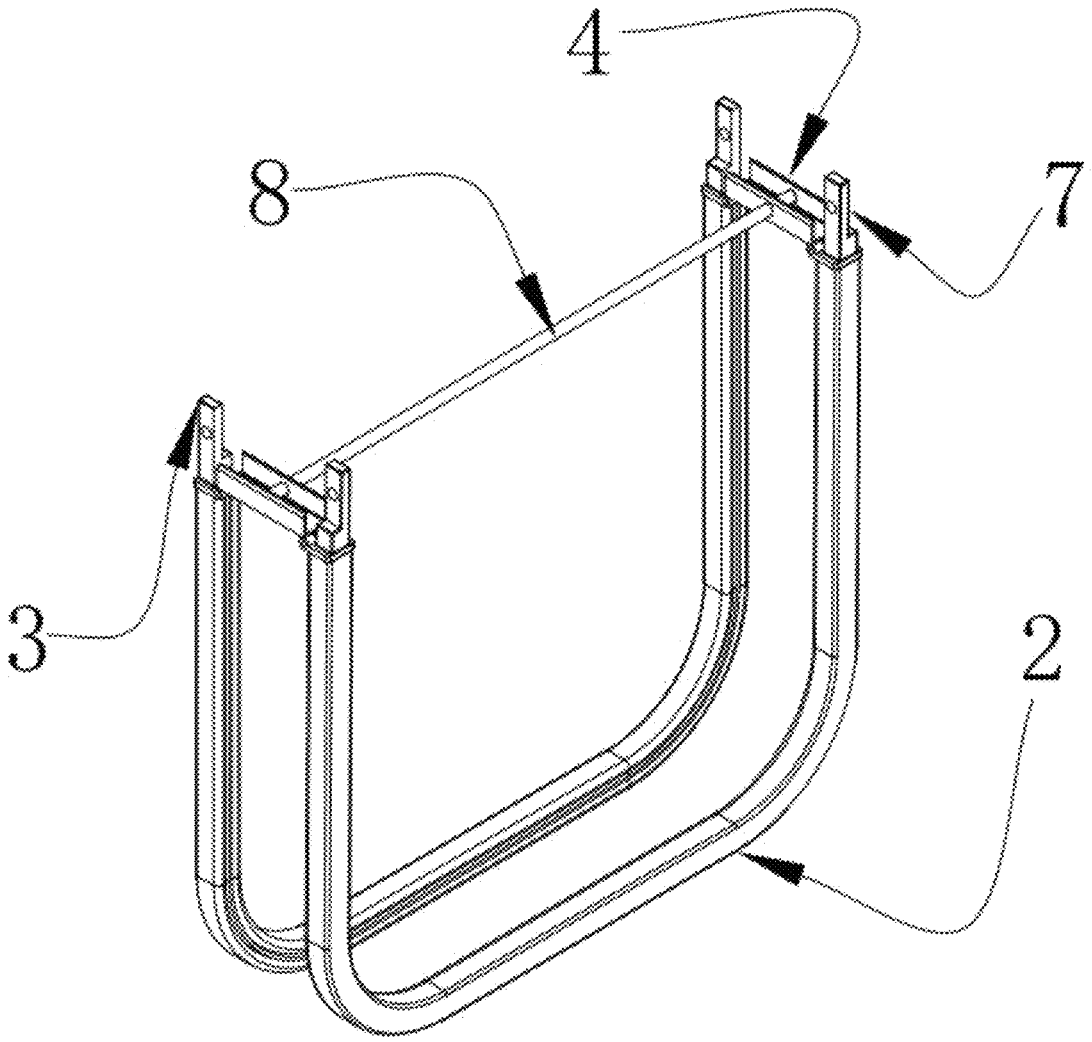
FIG. 4 is a three-dimensional structure diagram of unfolded borders and cover plate of a cloth bag frame for folding to squeeze out bar bends in the present utility model.
Figure 5:
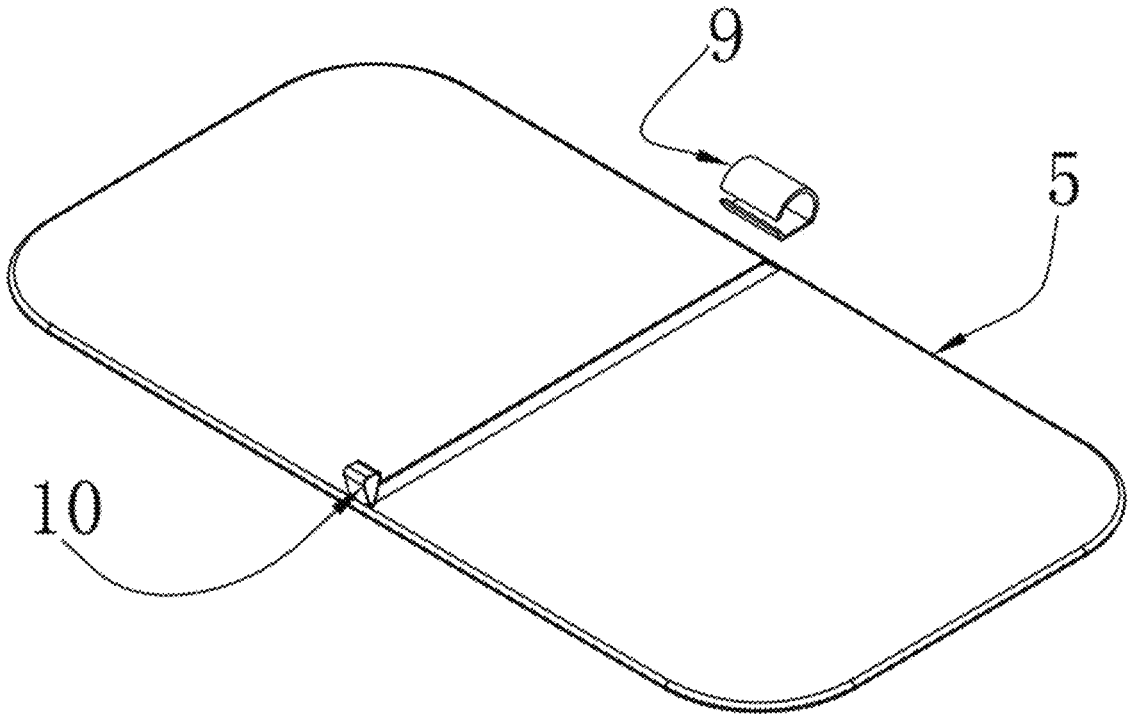
FIG. 5 is a three-dimensional structure diagram of a cover plate of a cloth bag frame for folding to squeeze out bar bends in the present utility model.

Referring to FIGS. 3-5, in the present embodiment, a second connecting member 7 is mounted on the left side of a right border 2; a connecting plate 4 is sleeved on the second connecting member 7; the connecting plate 4 and the second connecting member 7 are in movable connection through a circular hole 13 at a bottom portion, so that the right border 2 can be folded flexibly, which greatly ameliorates the defect that the traditional frames cannot be folded, thereby significantly reducing the occupied space when the frame lies idle, and facilitating storage and transportation;

the manner of the movable connection makes the process of assembling and disassembling the frame faster, easier, and more convenient; the reasonable design of the connecting member and the connecting plate 4 can enhance the strength of the connection between the right border 2 and the main body of the frame, thereby improving the structural stability of the entire frame; through holes are opened on surfaces of the first connecting member 3, the second connecting member 7, and the connecting plate 4; a roller 8 runs through the first connecting member 3, the second connecting member 7, and the connecting plate 4; the existence of the roller 8 greatly reduces the friction between the connecting members, smoothens the process of folding and unfolding the borders 2, and renders the operation easier, faster, and more convenient; the run-through connection of the roller 8 can provide a firmer manner of connection, so as to ensure that it is not easy to loosen or separate the connecting members when they are subjected to an external force, thereby enhancing the structural stability of the entire frame; a groove is opened on a surface of the cover plate 5; a pull ring 10 is mounted at an front end on an upper surface of the cover plate 5; a touch fastener 9 is mounted at a rear end on the upper surface of the cover plate 5; the groove can increase the friction on the surface of the cover plate 5 to prevent articles placed on the cover plate 5 from slipping off, and facilitate opening; when the cover plate 5 is closed, the touch fastener 9 at the rear end can tightly fit the cover plate 5 to the frame and prevent opening the cover plate 5 accidentally.

Figure 6:
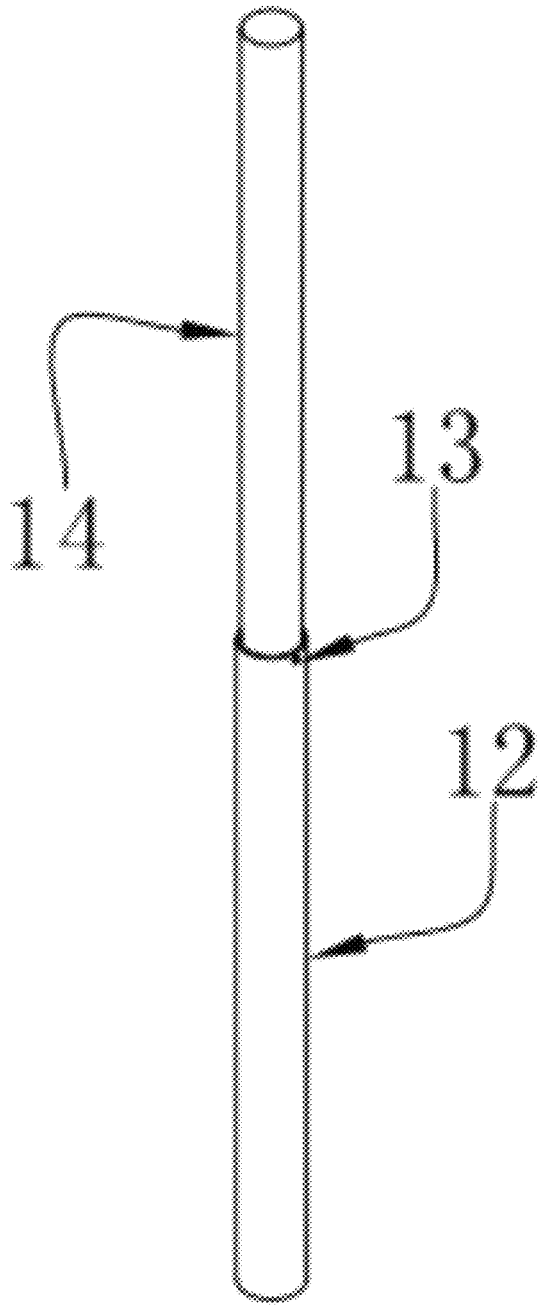
FIG. 6 is a three-dimensional structure diagram of a thick rod and a thin rod of a cloth bag frame for folding to squeeze out bar bends in the present utility model.
Figure 7:
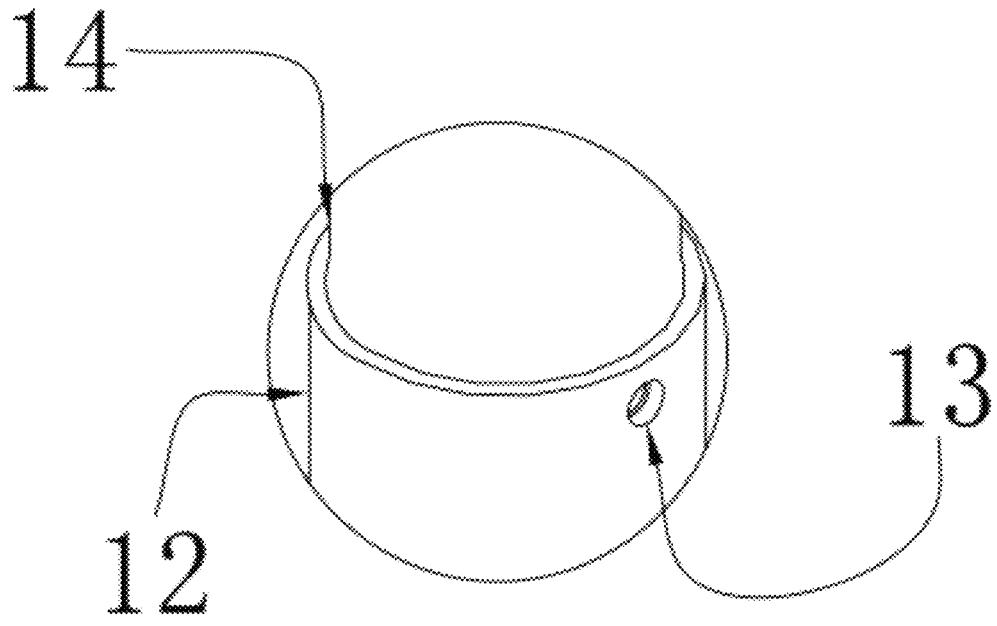
FIG. 7 is a partial enlarged three-dimensional structure diagram of a circular hole of a cloth bag frame for folding to squeeze out bar bends in the present utility model.

Referring to FIGS. 6-7, in the present embodiment, as a preferred option, one hole is opened on each corner at a bottom portion of the cloth cover 1; a cloth bag sleeve 11 is mounted in the hole; opening the hole on each corner and mounting the cloth bag sleeve 11 therein flexibly change the spatial layout inside the cloth cover 1, and improve the space utilization rate; a thick rod 12 is mounted inside the cloth bag sleeve 11; a thin rod 14 is mounted inside the thick rod 12; a circular hole 13 is opened at a top portion of the thick rod 12 and runs therethrough; a circular hole 13 is opened at a bottom portion of the thin rod 14 and runs therethrough; the circular hole 13 at the bottom portion of the thin rod 14 matches with the circular hole 13 at the top portion of the thick rod 12, so that the thin rod 14 can move up and down inside the thick rod 12, thereby realizing the height adjustment of the whole supporting structure and avoiding structural damage or failure; the adjustable supporting structure can better adapt to the shape and distribution of articles inside the cloth cover 1 and provide more uniform and more effective support.

When carrying out the work, an operator first rotates the borders 2 on both sides. Connected to both ends of the borders 2, the first connecting member 3, the second connecting member, and the connecting plate 4 are driven by the operator to unfold around the roller 8 in the middle. Then, the cover plate 5 is opened by pulling the pull ring 10 in cooperation with the touch fastener 9. After they are brought close together, the two circular holes of the thick rod 12 and the thin rod 14 are inserted into the hole opened at the bottom portion of the cloth cover, so as to enable them to stand on the ground.

Through the above steps, the borders 2, the first connecting member 3, the connecting plate 4, and the cover plate 5 are added. Connected at both ends of the borders 2, the first connecting member 3, the second connecting member, and the connecting plate 4 are driven by the operator to unfold around the roller 8 in the middle. When not in use, they can be folded, so that the occupied space is greatly reduced. Whether it is stored or transported, the limited space can be used more effectively. The special connection design on the left border 2 makes it more flexible to assemble and disassemble the frame, and can better adapt to cloth covers 1 in different sizes and shapes. The foldable design makes it more convenient and faster to unfold and fold the frame during use, and improves the work efficiency, so as to solve the problems of large space occupation, high transportation cost, and use inconvenience existing in the above traditional cloth bag frames.

The manner of implementation of the present utility model is elaborated above in combination with the drawings, but the present utility model is not limited by the above manner of implementation. Without departing from the purpose of the present utility model, persons skilled in the art can further make a variety of changes within their knowledge scope.

The invention claimed is:

1. A cloth bag frame for folding, comprising a cloth cover (1), wherein it further comprises borders (2), a first connecting member (3), a connecting plate (4), and a cover plate (5), two foldable borders (2) are mounted on the cloth cover (1), the first connecting member (3) is mounted on the right side of a left border (2), the connecting plate (4) is sleeved on the first connecting member (3), and the cover plate (5) for isolation from the outside world is mounted on the borders (2), wherein handles (6) are arranged at upper ends on both sides of the cloth cover (1), T-shaped plastic strips (15) are fixedly mounted at the upper ends on left and right sides of the cloth cover (1), and T-shaped plastic strips (15) are in snap-fit connection with bottom portions of the borders (2).

2. The cloth bag frame for folding of claim 1, wherein a second connecting member (7) is mounted on the left side of a right border (2), a connecting plate (4) is sleeved on the second connecting member (7).

3. The cloth bag frame for folding of claim 2, wherein through holes are opened on surfaces of the first connecting member (3), the second connecting member (7), and the connecting plate (4), and a roller (8) runs through the first connecting member (3), the second connecting member (7), and the connecting plate (4).

4. The cloth bag frame for folding of claim 3, wherein a groove is opened on a surface of the cover plate (5), a pull ring (10) is mounted at a front end on an upper surface of the cover plate (5), and a touch fastener (9) is mounted at a rear end on the upper surface of the cover plate (5).

5. The cloth bag frame for folding of claim 4, wherein a thick rod (12) is mounted inside the cloth bag sleeve (11), a thin rod (14) is mounted inside the thick rod (12), a circular hole (13) is opened at a top portion of the thick rod (12) and runs therethrough, and a circular hole (13) is opened at a bottom portion of the thin rod (14) and runs therethrough.

* * * * *